United States Patent [19]

Vlemmings et al.

[11] 3,945,779

[45] Mar. 23, 1976

[54] BEARINGS FOR THE TRUNNIONS OF GEARS IN GEAR PUMPS OR THE LIKE

[75] Inventors: Jan Vlemmings, Hochdorf; Wilhelm Dworak, Stuttgart, both of Germany

[73] Assignee: Robert Bosch GmbH, Stuttgart, Germany

[22] Filed: Aug. 15, 1974

[21] Appl. No.: 497,646

[30] Foreign Application Priority Data

Aug. 30, 1973 Germany ..... 7331510

[52] U.S. Cl. ..... 418/206; 74/414

[51] Int. Cl.[2] ..... F16H 1/06; F01C 1/18

[58] Field of Search ..... 418/206; 308/37, 73; 74/414

[56] References Cited

UNITED STATES PATENTS

| | | | |
|---|---|---|---|
| 3,270,680 | 9/1966 | Rich | 418/206 X |
| 3,574,492 | 4/1971 | Schwary | 418/206 |
| 3,778,202 | 12/1973 | Lindsay et al. | 418/206 |

*Primary Examiner*—Leonard H. Gerin
*Attorney, Agent, or Firm*—Michael J. Striker

[57] ABSTRACT

A gear pump wherein the trunnions of two or more mating gears are mounted directly in ring-shaped bearing members or in bearing sleeves which are fitted into the bearing members. The deformation of those surfaces of bearing members which are immediately adjacent to the end faces of the corresponding gears is prevented by enlarging the bores of the bearing members in close proximity to the end faces of the gears, by forming the internal surfaces of the bearing members with circumferentially complete or arcuate grooves, or by reducing the outer diameters of bearing sleeves in immediate proximity to the end faces of the gears. This insures that the deformation of bearing members in response to transmission of forces by the respective trunnions is not propagated all the way to those surfaces of the bearing members which are immediately adjacent to the end faces of the gears.

15 Claims, 7 Drawing Figures

BEARINGS FOR THE TRUNNIONS OF GEARS IN GEAR PUMPS OR THE LIKE

BACKGROUND OF THE INVENTION

The present invention relates to gear pumps or analogous fluid displacing machines wherein the means for conveying a fluid (e.g., oil) from the inlet to the outlet of a housing comprises the teeth of two or more mating spur gears, herringbone gears or helical gears.

The gears of a gear pump are provided with trunnions which are journalled in bearing structures mounted in or forming part of the pump housing. When the gears are rotated by a highly pressurized fluid, or when the gears are used to pressurize a fluid, the trunnions transmit to the respective bearing structures forces of substantial magnitude. Such forces are likely to damage or destroy the bearing structures and/or the gears. In many instances, the forces are large enough to effect a pronounced distortion of that surface of a bearing structure (e.g., a ring-shaped body which surrounds a trunnion with minimal clearance) which is immediately adjacent to the respective end face of the adjacent gear. This causes excessive leakage of fluid and results in pronounced wear which can bring about rapid destruction of the bearing structure, trunnion and/or gear.

SUMMARY OF THE INVENTION

An object of the invention is to provide a gear pump or an analogous fluid displacing, conveying and/or pressurizing machine with novel and improved bearing structures which surround the trunnions of the gears and are constructed and configurated in such a way that the forces which the trunnions apply while the machine displaces a fluid cannot result in undue distortion of and/or excessive wear upon those surfaces which are adjacent to the end faces of the gears.

Another object of the invention is to provide the bearing structures for the trunnions of gears in gear pumps or the like with novel and improved means for confining the deformation of bearing structures to regions which are remote from the respective gears.

A further object of the invention is to provide a gear pump which embodies one or more improved bearing structures for the trunnions of gears and wherein the deformation of bearing structures when the pump is in use does not result in excessive leakage of conveyed fluids.

The invention is embodied in a gear pump or an analogous fluid displacing machine which comprises a pair of mating rotary gears each having two end faces and at least one of the gears having a trunnion which extends from one of its end faces, and a bearing structure for the trunnion. The bearing structure includes a ring-shaped body which is installed in or forms part of the housing of the fluid displacing machine, which surrounds the trunnion, and which has a surface closely adjacent to the one end face of the one gear. When the machine displaces fluid, the trunnion is urged against the bearing structure whereby the trunnion applies against the ring-shaped body a resultant force acting substantially radially of the ring-shaped body and tending to deform that portion of the ring-shaped body which is located within a predetermined distance from the locus of application of the force to the bearing structure. In accordance with a feature of the invention, the bearing structure includes or embodies means for confining the ambit of the resultant force to a region of the ring-shaped body which is remote from the aforementioned surfaces of the ring-shaped body so that the application of such resultant force does not entail appreciable deformation or distortion of the surface of the ring-shaped body.

For example, the bearing structure may further comprise a bearing sleeve which is installed in the ring-shaped body and surrounds the trunnion so that the application of resultant force to the ring-shaped body takes place through the medium of the bearing sleeve. The bearing sleeve is preferably spaced apart from the one end face of the one gear, and the ring-shaped body has a bore for the bearing sleeve. This bore includes a first portion which snugly receives the bearing sleeve and a larger-diameter second portion which is adjacent to the one end face of the one gear. The confining means constitutes that portion of the ring-shaped body which surrounds the second portion of the bore. That end portion of the bearing sleeve which is nearer to (but spaced apart from) the one end face of the one gear preferably extends with clearance into the second portion of the bore in the ring-shaped body. The axial length of the second portion of the bore in the ring-shaped body is selected in such a way that the resultant force which acts upon the ring-shaped body through the medium of the bearing sleeve and is necessarily applied only to that portion of the ring-shaped body which surrounds the first portion of the bore is sufficiently remote from the one end face of the one gear to prevent any or to prevent appreciable distortion of that surface of the ring-shaped body which is adjacent to the one end face of the gear.

The novel features which are considered as characteristic of the invention are set forth in particular in the appended claims. The improved bearing structure itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
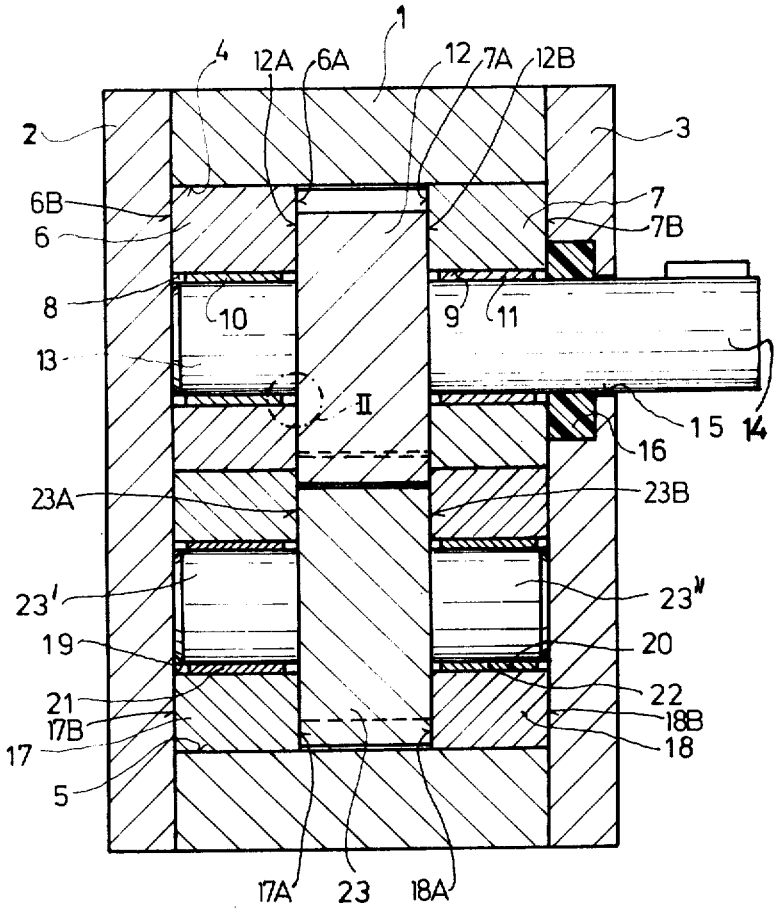
FIG. 1 is a sectional view of a gear pump wherein the bearing structure for each of the trunnions of two mating gears is constructed and assembled in accordance with a first embodiment of the invention.

FIG. 1 shows a gear pump having a housing including a centrally located main section 1 and two end sections or cover members 2, 3 which are bolted or otherwise sealingly connected to the open ends of the main section 1. The main section 1 is formed with two parallel bores 4 and 5 which partially overlap each other so as to form a chamber having a substantially 8-shaped cross-sectional outline. Two mating gears 12 and 23 are respectively disposed in the central portions of bores 4, 5 and respectively comprise coaxial trunnions 13, 14 and 23', 23''. The gear 12 is positively driven by a suitable motor, not shown, and its trunnion 14 constitutes a drive shaft which is rotated by the output member of the motor, either directly or through the intermediary of a suitable transmission. The shaft 14 extends through a ring-shaped packing 16 in the cover member 3. The packing 16 is mounted in a larger-diameter portion of a bore 15 in the cover member 3. The inlets and outlets of the housing 1-3 are not shown in the drawing; for example, the inlet can be located behind the gears 12, 23 and the outlet can be located in front of the gears, as viewed in FIG. 1. When the machine is in operation, the shaft 14 rotates the gear 12 whereby the gear 12 rotates the idler gear 23 and the gears cause a fluid to flow from the inlet toward the outlet. The fluid is thereby pressurized in a manner well known from the art of gear pumps.

The bearing structure for the trunnion 13 of the driven gear 12 comprises a ring-shaped body 6 which is snugly received in the left-hand end portion of the bore 4 adjacent to the cover member 2, and a cylindrical bearing sleeve 10 which directly surrounds the trunnion 13 and is snugly received in an axial bore 8 of the ring-shaped body 6 (hereinafter called ring for short).

The bearing structure for the drive shaft or trunnion 14 comprises a ring 7 which is snugly received in the right-hand end portion of the bore 4 and has a bore 9 for a cylindrical bearing sleeve 11. The bearing structure for the trunnion 23' comprises a ring 17 having a bore 19 for a bearing sleeve 21, and the bearing structure for the trunnion 23'' comprises a ring 18 having a bore 20 for a bearing sleeve 22.

The surfaces 6A, 7A of the rings 6, 7 are immediately adjacent to the respective end faces 12A, 12B of the driven gear 12, and the surfaces 17A, 18A of the rings 17, 18 are immediately adjacent to the end faces 23A, 23B of the idler gear 23. Each of the bearing sleeves 10, 11, 21, 22 is preferably a press-fit in the bore of the respective ring. It will be noted that each of the bearing sleeves 10, 11, 21, 22 is spaced apart from the respective end face 12A, 12B, 23A, 23B of the associated gear.

The cover members 2, 3 and/or the outer surfaces 6B, 7B, 17B, 18B of the rings 6, 7, 17, 18 are formed with suitable channels or the like to produce pressure fields which urge the surfaces 6A, 7A, 17A, 18A toward the respective end faces 12A, 12B, 23A, 23B. Such channels preferably communicate with the pressure side of the pump in a well known manner not forming part of the invention.

Figure 2:
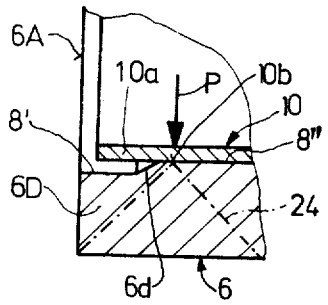
FIG. 2 is an enlarged fragmentary view of one of the bearing structures shown in FIG. 1, the illustrated portion of the one bearing structure being that which is located within the phantom-line circle II in FIG. 1 and is shown in inverted position.

The details of the bearing structure 6, 10 for the trunnion 13 of the gear 12 are shown in FIG. 2. This bearing structure comprises the aforementioned confining means which prevents excessive deformation or distortion of the surface 6A on the ring 6 when the pump is in use and the trunnion 13 is urged against the bearing structure 6, 10 to apply against the ring 6 a resultant force P acting substantially radially of the bearing sleeve 10 and tending to deform a certain portion of the ring 6. Such portion is shown in FIG. 2 within the phantom-line triangle 24. The portion (within the triangle 24) which is likely to undergo deformation or is actually deformed when the machine displaces a fluid (e.g., oil) is located within a predetermined distance of the locus **10*b* of the application of resultant force P to the internal surface of the ring 6. The purpose of the confining means is to insure that the ambit of the force P is confined to or localized in that portion of the ring 6 which is remote from the surface 6A so that the surface 6A undergoes a negligible distortion or is not distorted at all and cannot rub against the adjacent end face 12A of the gear 12** with a force which would be likely to cause rapid destruction of the machine.

The bore 8 in the ring 6 has a smaller-diameter portion 8'' which snugly receives the bearing sleeve 10 and a larger-diameter portion 8' which is immediately adjacent to the surface 6A and hence to the end face 12A of the gear 12. The transition between the portions 8' and 8'' of the bore 8 may be gradual, as shown at **6*d*. The diameter of the portion 8' exceeds the outer diameter of the bearing sleeve 10, i.e., the end portion 10*a* of the sleeve 10 extends with clearance into that portion 6D of the ring 6 which surrounds the portion 8' of the bore 8. It will be noted that the end portion 10*a* is spaced apart from the surface 6A and hence from the end face 12A of the gear 12. The portion 6D can be said to constitute the aforementioned confining means of the bearing structure 6, 10 because it insures that the locus 10*b* is sufficiently remote from the surface 6A to prevent appreciable distortion of such surface when the pump is in use and the teeth of gears 12, 23 convey a fluid from the inlet toward the outlet of the housing 1–3. For example, the length of the portion 8' of the bore 8 in the ring 6** may be about 6 millimeters.

The construction of the bearing structures 7, 11 and 17, 21 and 18, 22 is preferably identical to that of the bearing structure 6, 10 of FIG. 2.

An important advantage of the bearing structure of FIG. 2 is its utter simplicity. Thus, all that is necessary is to enlarge the bore 8 of the ring 6 in the region of the surface 6A and to dimension and/or mount the bearing sleeve 10 in such a way that its end portion **10*a* does not extend all the way to the surface 6A and end face 12A.**

Figure 3:
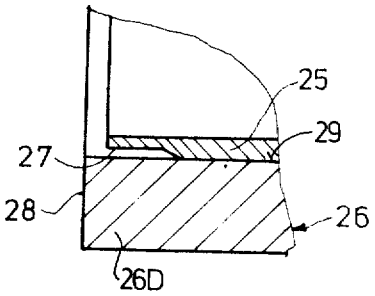
FIG. 3 is a similar fragmentary sectional view of a second bearing structure.

FIG. 3 shows a first modification of the bearing structure of FIG. 2. The surface 28 of the ring 26 corresponds to the surface 6A of the ring 6. The major portion of the bearing sleeve 25 is snugly received in the bore 29 of the ring 26; however, the end portion 27 of the sleeve 25 has an outer diameter which is smaller than the diameter of the bore 29 so that the end portion 27 is spaced apart from the surrounding portion 26D of the ring 26. In this embodiment of the bearing structure, the end portion 27 of the sleeve 25 constitutes a confining means which insures that the resultant force which is applied to the ring 26 by a trunnion in the sleeve 25 acts upon the ring at a locus which is sufficiently remote from the surface 28 to guarantee that the surface 28 is not unduly deformed or distorted when the machine is in use. It will be noted that the end portion 27 does not extend all the way to the surface 28, i.e., this end portion is also spaced apart from that end face of a gear which is adjacent to the surface 28.

Figure 4:
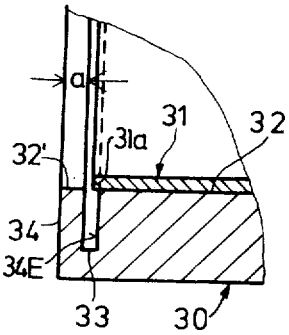
FIG. 4 is a similar fragmentary sectional view of a third bearing structure.

The bearing structure of FIG. 4 consists of a ring 30 having a surface 34 corresponding to the surface 6A of the ring 6, and a bearing sleeve 31 which is snugly received in the bore 32 of the ring 30. The confining means comprises a preferably endless groove or recess 33 which is machined into the surface 32' surrounding the bore 32 and is spaced apart from the surface 34 (see the distance *a*). The end portion 31*a* of the bearing sleeve 31 terminates in the region of the groove 33, e.g., midway between the axial ends of the groove. The distance *a* and the depth of the groove 33 are selected in such a way that, when the trunnion in the sleeve 31 applies a resultant force to a portion of the ring 30 (i.e., to that portion which is located to the right of the groove 33, as viewed in FIG. 4), the deformed portion of the ring does not extend all the way to the surface 34. As a rule, the deformation will or can reach that surface (34E) which flanks the right-hand side of the groove 33. If desired, the bearing sleeve 31 can be dimensioned and/or mounted in such a way that its left-hand end face is flush with the surface 34E.

Figure 5:
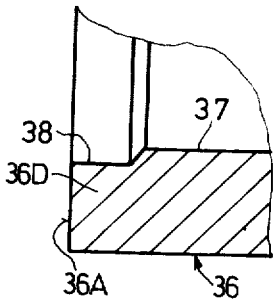
FIG. 5 is a similar fragmentary sectional view of a fourth bearing structure.

In the embodiment of FIG. 5, the bearing structure consists of a ring 36 having a surface 36A corresponding to the surface 6A of the ring 6. The ring 36 has a bore including a smaller-diameter portion 37 which is remote from the surface 36A (and from the corresponding end face of a gear whose trunnion extends into the ring 36) and a larger-diameter portion 38 which is immediately adjacent to the surface 36A. It will be seen that the bearing structure of FIG. 5 is analogous to that of FIG. 2, the only major difference being that the sleeve 10 is omitted so that the trunnion bears directly against a portion of the surface surrounding the smaller-diameter portion 37 of the bore in the ring 36. The confining means of the bearing structure shown in FIG. 5 is that portion (36D) of the ring 36 which surrounds the larger-diameter portion 38 of the bore.

Figure 6:
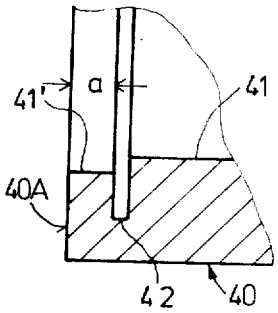
FIG. 6 is a similar fragmentary sectional view of a fifth bearing structure.

FIG. 6 shows a bearing structure which consists of a ring 40 having a bore 41 which receives the trunnion of a gear (not shown). One end face of the gear is adjacent to the surface 40A of the ring 40. The confining means includes a preferably endless groove or recess 42 which is machined into the internal surface of the ring 40 and is spaced apart from the surface 40A by a distance *a*. The bore 41 preferably includes a smaller-diameter portion which is located at the right-hand side of the groove 42 and a larger-diameter portion 41' which extends between the surface 40A and the groove 42. The trunnion bears only against that portion of the internal surface of the ring 40 which surrounds the smaller-diameter portion of the bore 41. The depth of the groove 42 and the distance *a* are selected in such a way that the deformation of ring 40 under the bias of the trunnion is not propagated all the way to the surface 40A. It will be noted that the bearing structure of FIG. 6 is analogous to that shown in FIG. 4.

Figure 7:
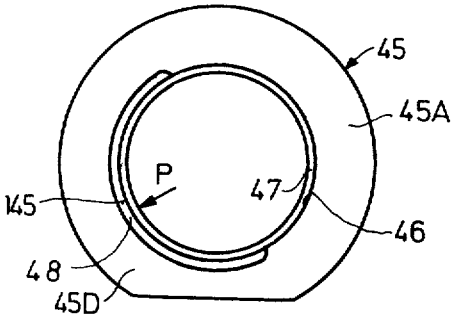
FIG. 7 is an end elevational view of a sixth bearing structure.

FIG. 7 shows that the confining means of the bearing structure need not extend all the way around the trunnion. It is sufficient if the confining means extends to both sides of the locus 145 of impingement of the resultant force P to a ring-shaped body 45, as considered in the circumferential direction of the trunnion (not shown in FIG. 7) and substantially within the ambit of the force P. The ring 45 of FIG. 7 has a bore 46 which snugly receives a bearing sleeve 47. The surface 45A of the ring 45 corresponds to the surface 6A of the ring 6. The radius of the major portion of the bore 46 is constant and equals the radius of the cylindrical external surface of the bearing sleeve 47. However, a portion of the bore 46 has a larger radius so that such portion forms an arcuate groove or recess 48 extending along an arc of approximately 180°, i.e., along 90° to both sides of the locus 145. The portion 45D of the ring 45 surrounds the groove 48 and constitutes the confining means of the bearing structure shown in FIG. 7. In this embodiment of the invention, the groove 48 extends all the way to the surface 45A. However, it is also possible to move the groove 48 inwardly, i.e., away from the surface 45A, so that the groove 48 will constitute one-half of the circumferentially complete groove 33 shown in FIG. 4. The bearing sleeve 47 need not extend all the way to the surface 45A.

It is further clear that the bearing structure of FIG. 5 or 6 can be modified so as to more closely resemble the bearing structure of FIG. 7. Thus, the groove 42 of FIG. 6 may extend only along an arc of approximately 180°, and the portion 38 of the bore 37 shown in FIG. 5 need not extend along an arc of 360° but only along such an arc as is necessary to avoid a deformation of the surface 36A due to the application of a force to the surface surrounding the smaller-diameter portion of the bore 37.

It is further clear that the rings 6, 17 and/or 7, 18 may be made integral with each other so that they form two substantially 8-shaped bodies having two bores one for one trunnion of the gear 12 and the other for one trunnion of the gear 23. This also applies for the ring-shaped bodies which are shown in FIGS. 3 through 7.

Without further analysis, the foregoing will so fully reveal the gist of the present invention that others can by applying current knowledge, readily adapt it for various applications without omitting features which fairly constitute essential characteristics of the generic and specific aspects of out contribution to the art and, therefore, such adaptations should and are intended to be comprehended within the meaning and range of equivalence of the claims.

What is claimed as new and desired to be protected by Letters Patent is set forth in the appended claims:

1. In a gear pump or an analogous fluid displacing machine, a combination comprising a pair of mating rotary gears each having two end faces and one of said gears having a trunnion extending from one of the respective end faces; and a bearing structure including a ring-shaped body surrounding said trunnion and having a surface immediately adjacent to said one end face of said one gear, said trunnion being urged against said bearing structure when the machine displaces fluid whereby said trunnion applies against said body a resultant force acting substantially radially of said body and tending to deform that portion of said body which is located within a predetermined distance from the locus of application of said force to said bearing structure, said bearing structure having means for confining the ambit of said force to a region of said body which is remote from said surface so that the application of said force does not entail appreciable distortion of said surface such as would result in wear owing to friction between said surface and said one end face due to immediate proximity of said surface to said one end face.

2. A combination as defined in claim 1, wherein said bearing structure further comprises a bearing sleeve installed in said ring-shaped body and surrounding said trunnion so that the application of said resultant force to said body takes place through the medium of said sleeve, said sleeve being spaced apart from said one end face of said one gear.

3. A combination as defined in claim 2, wherein said body has a bore for said sleeve and said bore includes a first portion snugly receiving said sleeve and a larger-diameter second portion adjacent to said one end face of said one gear, said confining means including that portion of said body which defines said second portion of said bore.

4. A combination as defined in claim 3, wherein said sleeve has an end portion which extends with clearance into said second portion of said bore.

5. A combination as defined in claim 2, wherein said sleeve has an end portion adjacent to but spaced from said one end face of said one gear and having an outer diameter which is less than the diameter of said bore so that said end portion is spaced apart from the surrounding portion of said body, said end portion of said sleeve constituting said confining means.

6. A combination as defined in claim 2, wherein said body has an internal surface surrounding said bore and said confining means includes a circumferentially extending groove provided in said internal surface and spaced apart from said one end face of said one gear.

7. A combination as defined in claim 6, wherein the distance between said one end face of said one gear and said sleeve approximates the distance between said groove and said one end face of said one gear.

8. A combination as defined in claim 1, wherein said bearing structure consists of said ring-shaped body and said body has a bore for said trunnion, said bore including a smaller-diameter portion remote from said one end face of said one gear and a larger-diameter portion adjacent to said one end face of said one gear, said confining means constituting that portion of said body which surrounds said larger-diameter portion of said bore.

9. A combination as defined in claim 1, wherein said bearing structure consists of said ring-shaped body and said body has a bore for said trunnion and an internal surface surrounding said bore, said confining means including a circumferentially extending groove provided in said internal surface and being spaced apart from said one end face of said one gear.

10. A combination as defined in claim 9, wherein said bore has a smaller-diameter portion disposed at that side of said groove which is remote from said one end face of said one gear and a larger-diameter portion between said groove and said one end face of said one gear.

11. A combination as defined in claim 1, wherein said bearing structure has a bore for said trunnion and said confining means extends to both sides of said locus, as considered in the circumferential direction of said bearing structure, and substantially within said ambit.

12. A combination as defined in claim 11, wherein said body has a bore for said trunnion and said last mentioned bore includes a first portion remote from said one end face of said one gear and having a first radius, and a second portion nearer to said one end face of said one gear and having a greater second radius, said confining means constituting that portion of said body which surrounds said second portion of said bore.

13. A combination as defined in claim 12, wherein said second portion of said last mentioned bore extends along an arc of approximately 180°, as considered in the circumferential direction of said trunnion.

14. A combination as defined in claim 13, wherein said body has an internal surface surrounding said last mentioned bore and said second portion of said last mentioned bore constitutes an arcuate groove provided in said internal surface and spaced apart from said one end face of said one gear.

15. A combination as defined in claim 13, wherein said body has an internal surface surrounding said last mentioned bore and said second portion of said last mentioned bore extends all the way to said one end face of said one gear.

* * * * *